US007530203B1

(12) United States Patent
Hare et al.

(10) Patent No.: US 7,530,203 B1
(45) Date of Patent: May 12, 2009

(54) PRE-CAST CONCRETE WALL WITH TRUSS LEDGE

(75) Inventors: Robert W. Hare, East Earl, PA (US); Melvin M. Zimmerman, Denver, PA (US)

(73) Assignee: SWA Holding Company, Inc., Wilmington, DE (US)

( * ) Notice: Subject to any disclaimer, the term of this patent is extended or adjusted under 35 U.S.C. 154(b) by 654 days.

(21) Appl. No.: 10/981,905

(22) Filed: Nov. 5, 2004

(51) Int. Cl.
*E04B 1/00* (2006.01)
*E04B 1/74* (2006.01)

(52) U.S. Cl. ..... 52/251; 52/250; 52/404.1

(58) Field of Classification Search ..... 52/272, 52/702, 289, 250, 274, 169.11, 733.2, 737.6, 52/677–681, 251, 404.1
See application file for complete search history.

(56) References Cited

U.S. PATENT DOCUMENTS 1,773,168 A * 8/1930 Brostrom ..... 52/332
3,956,859 A * 5/1976 Ingestrom ..... 52/169.11
4,409,766 A * 10/1983 Blackmore ..... 52/169.11
4,472,620 A * 9/1984 Nied ..... 219/120
4,570,398 A * 2/1986 Zimmerman ..... 52/169.11
RE33,566 E * 4/1991 Heckelsberg ..... 52/520
5,152,119 A * 10/1992 Miller ..... 52/731.3
5,704,172 A * 1/1998 Gougeon et al. ..... 52/169.11
6,003,278 A * 12/1999 Weaver et al. ..... 52/414
6,427,406 B1 * 8/2002 Weaver et al. ..... 52/414
6,463,702 B1 * 10/2002 Weaver et al. ..... 52/79.1
6,494,004 B1 * 12/2002 Zimmerman ..... 52/251
6,698,150 B1 * 3/2004 DiLorenzo ..... 52/414
6,805,819 B2 * 10/2004 Tsuyuki et al. ..... 264/37.19
7,017,316 B2 * 3/2006 DiLorenzo ..... 52/414

* cited by examiner

*Primary Examiner*—Richard E Chilcot, Jr.
*Assistant Examiner*—Andrew J Triggs
(74) *Attorney, Agent, or Firm*—Miller Law Group, PLLC

(57) ABSTRACT

A pre-cast concrete wall system that incorporates a truss ledge for positioning a building floor system at a below-grade location. The truss ledge is defined by a vertical wall formed as a continuation of the exterior wall of the wall panel extending from the footer beam to the upper bond beam and projecting vertically above the upper bond beam to provide a support surface for the building floor members. A floor truss system can be supported on the upper bond beam with the truss ledge forming a concrete below-grade surface externally of the floor trusses. Galvanized steel stud facings incorporating fold-up reinforcing bar supports are used on the interior surface of the vertical wall beams. Insulated access holes are formed through the vertical beams for the passage of wiring and plumbing behind the wall finish to be fastened to the stud facings.

14 Claims, 6 Drawing Sheets

Fig. 3
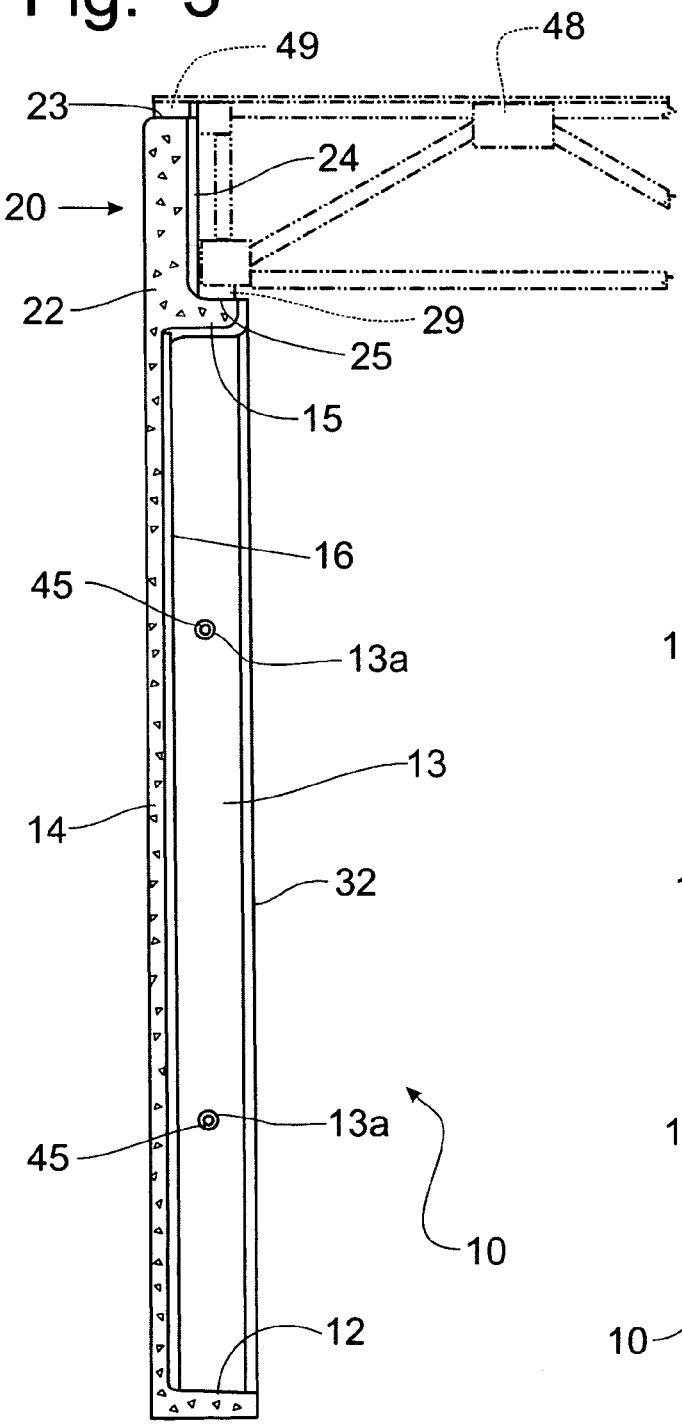
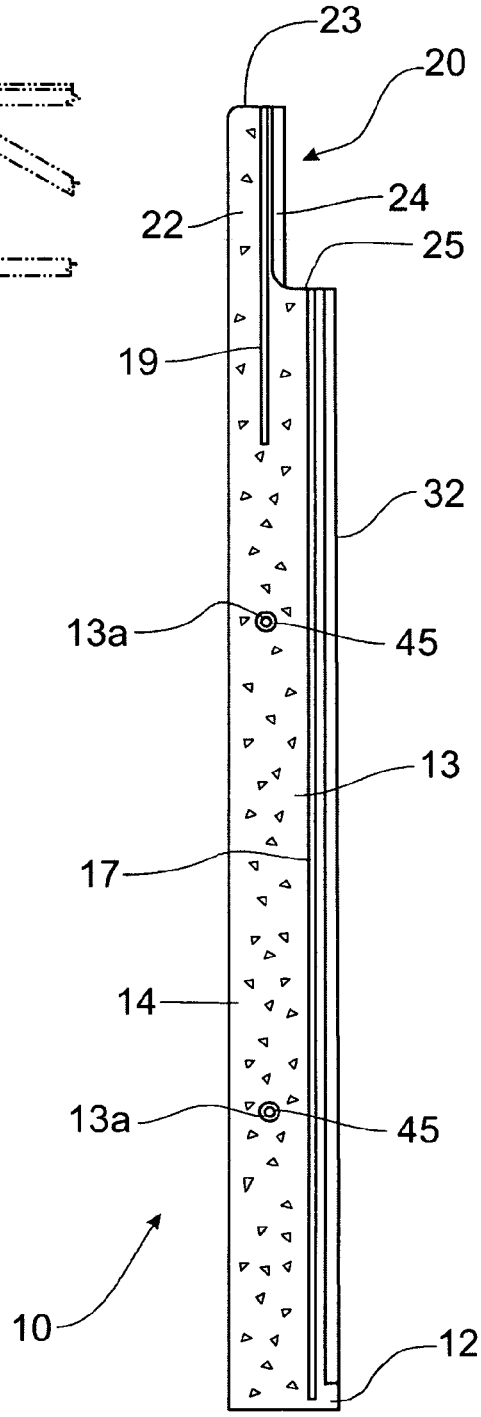
Fig. 4

Fig. 5
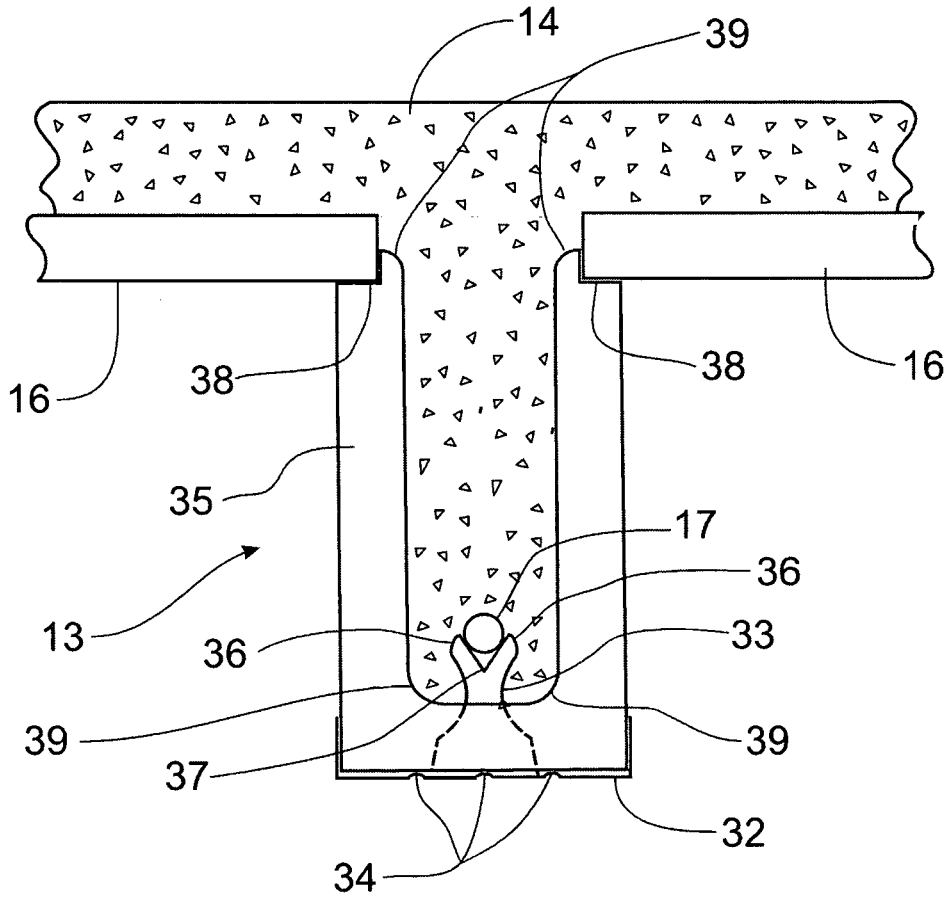
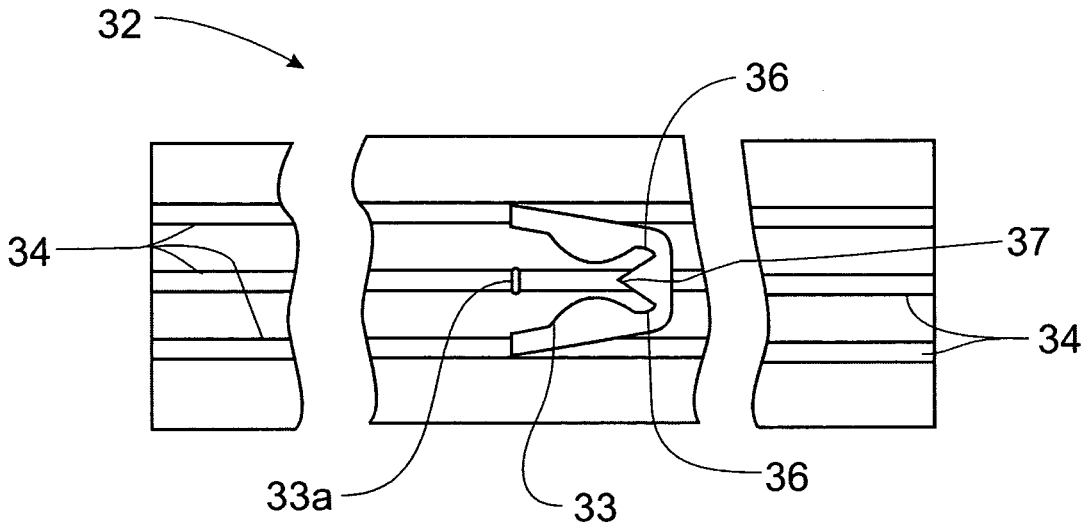
Fig. 8

Fig. 6
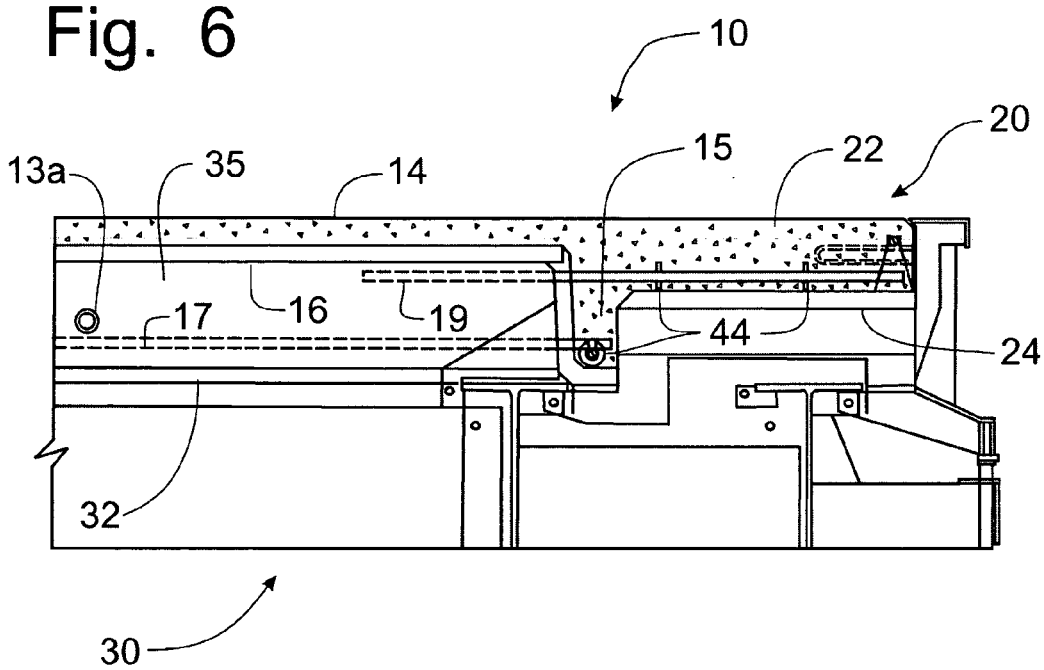
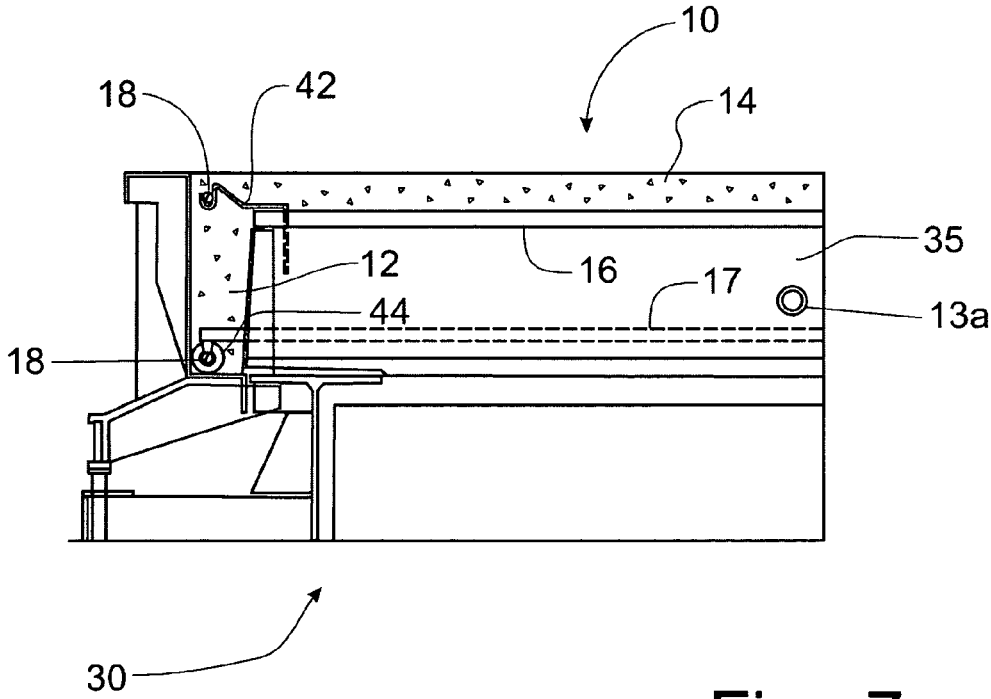
Fig. 7

Fig. 10
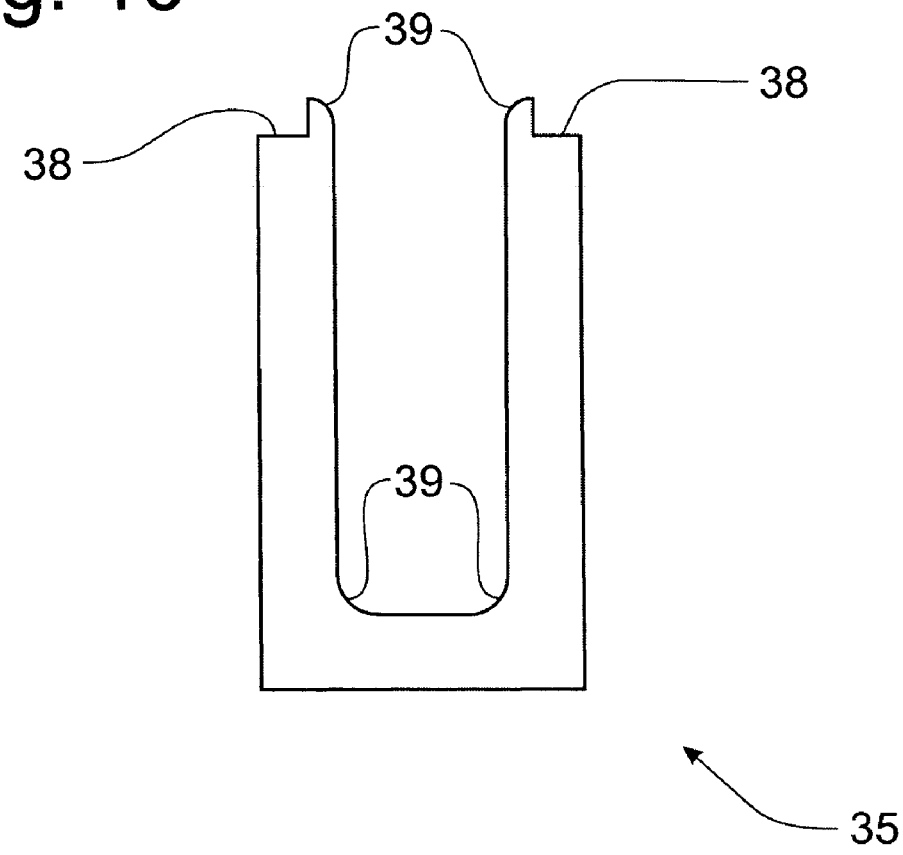
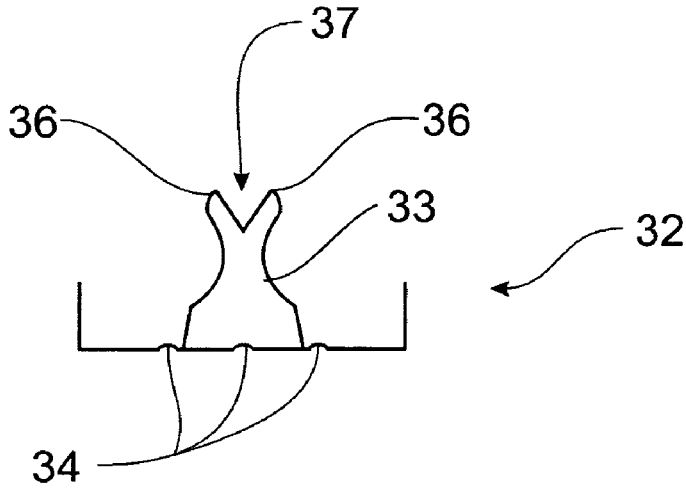
Fig. 9

PRE-CAST CONCRETE WALL WITH TRUSS LEDGE

BACKGROUND OF THE INVENTION

The present invention relates generally to the pre-cast concrete wall systems and, more particularly, to a pre-cast concrete wall system that incorporates a support for a floor truss system.

Pre-cast concrete wall systems are known in the art, as can be found, for example, in U.S. Pat. No. 6,494,004, issued to Melvin Zimmerman on Dec. 17, 2002. Such pre-cast concrete walls are typically used as basement walls for building structures, for example, houses and commercial buildings. Such walls are manufactured in a production plant by assembling non-concrete components into a form and pouring concrete into the form to encapsulate the non-concrete components. Once the concrete has hardened, the form is stripped away from the manufactured wall and the wall panel is transported to the job site for installation. Typically, a plurality of wall panels is assembled on the job site to form a basement structure of the building to be constructed thereon.

The pre-cast concrete walls are formed with a concrete footer beam that extends along the bottom of the wall panel and a concrete upper bond beam that extends along the top of the wall panel. Each panel also includes a number of structural members or studs, which are oriented vertically when the wall panels are assembled into a basement wall, that extend between the upper bond beam and the footer beam. These vertical studs are also formed from concrete but are faced with wood or other non-concrete material to permit the attachment of a finished wall panels, such as drywall or paneling. The top of the upper bond beam will accept the connection of a sill plate for the attachment of the floor structure of the building to be constructed with the top of the pre-cast concrete wall being below the floor structure.

In some areas of the country, such as the Southwest area of the United States, building practices require the floor structure to be recessed below grade so that adjacent slab on grade portions of the building may have the same finished floor level as the floor over the basement portion of the building, meaning that the concrete basement wall must cover the support members of the building floor. In such situations, the use of the conventional pre-cast concrete wall system is hindered as the wall structure is not configured to support the building floor below the upper surface of the upper bond beam. Accordingly, it would be desirable to provide a pre-cast concrete wall structure that would support building floor systems at a below-grade position.

SUMMARY OF THE INVENTION

It is an object of this invention to overcome the aforementioned disadvantages of the known prior art by providing a pre-cast concrete wall system that incorporates a truss ledge for support of a below-grade building floor system.

It is another object of this invention to provide a pre-cast concrete wall panel that provides for a grade line that is above the support members of a building floor system.

It is still another object of this invention to provide a pre-cast concrete wall system that can be utilized in areas of the country in which the building floor must be supported by structure that is located below grade.

It is a feature of this invention that the pre-cast concrete wall panel incorporates a vertical truss ledge that projects above the upper bond beam to provide an exterior basement surface corresponding to a truss floor system.

It is an advantage of this invention that the floor trusses can be supported on the pre-cast concrete wall system at a below grade position.

It is another advantage of this invention that the pre-cast wall system can be manufactured at an off-site location in a manner that is consistent with the building specifications.

It is still another feature of this invention that the vertical studs incorporate insulated access holes for the passage of wiring and plumbing materials. It is another feature of this invention that the pre-cast concrete wall panel is monolithicly poured to enhance strength of the wall panel.

It is still another feature of this invention that openings for windows and doors can be incorporated into the pre-cast form structure.

It is yet another feature of this invention that interior face of the vertical studs of the pre-cast concrete wall panel is formed with galvanized steel facing for the mounting of finished wall materials to the wall panel.

It is still another feature of this invention that the galvanized steel stud facing incorporates fold-up members that support reinforcing rods in the form before concrete is poured and hardened to form the wall panel.

It is yet another advantage of this invention that the fold-up members incorporate the galvanized steel facing member into the pre-cast concrete wall panel.

It is a further feature of this invention that the pre-cast concrete wall system forms a reinforced upper bond beam that supports floor trusses at a below-grade location.

It is a further feature of this invention that the wall panel incorporates a foam insulation panel on the interior of the vertical truss ledge wall.

It is yet another object of this invention to provide a pre-cast concrete wall system incorporating a truss ledge for positioning floor support members below grade, that is durable in construction, inexpensive of manufacture, carefree of maintenance, facile in assemblage, and simple and effective in use.

These and other objects, features and advantages are accomplished according to the instant invention by providing a pre-cast concrete wall system that incorporates a truss ledge for positioning a building floor system at a below-grade location. The truss ledge is defined by a vertical wall formed as a continuation of the exterior wall of the wall panel extending from the footer beam to the upper bond beam and projecting vertically above the upper bond beam to provide a support surface for the building floor members. A floor truss system can be supported on the upper bond beam with the truss ledge forming a concrete below-grade surface externally of the floor trusses. Galvanized steel stud facings incorporating fold-up reinforcing bar supports are used on the interior surface of the vertical wall beams. Insulated access holes are formed through the vertical beams for the passage of wiring and plumbing behind the wall finish to be fastened to the stud facings.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

FIG. 3 is a cross-sectional view of the basement foundation taken along lines 3-3 of FIG. 2 to depict a side elevational view of the wall panel looking into a vertical concrete stud, the representative floor truss system, supported on the upper bond beam, being shown in phantom;

FIG. 4 is a cross-sectional view of the basement foundation taken along lines 4-4 of FIG. 2 passing vertically through a concrete stud;

FIG. 5 is an enlarged cross-sectional view of a concrete stud taken along lines 5-5 of FIG. 2;

FIG. 6 is a partial sectional view of the pre-cast concrete wall panel in the form to show the upper bond beam and truss ledge end of the wall panel;

FIG. 7 is a partial sectional view of the pre-cast concrete wall panel in the form to show the footer beam end of the wall panel;

FIG. 8 is a plan view of the galvanized stud facing with portions being broken away to show the formation of the fold-up reinforcing bar support;

FIG. 9 is an end view of the galvanized stud facing with the reinforcing bar support positioned to engage the polystyrene foam channel and to support the reinforcing bar in the concrete stud; and FIG. 10 is an enlarged end view of the polystyrene foam channel.

DETAILED DESCRIPTION OF THE PREFERRED EMBODIMENT

Figure 1:
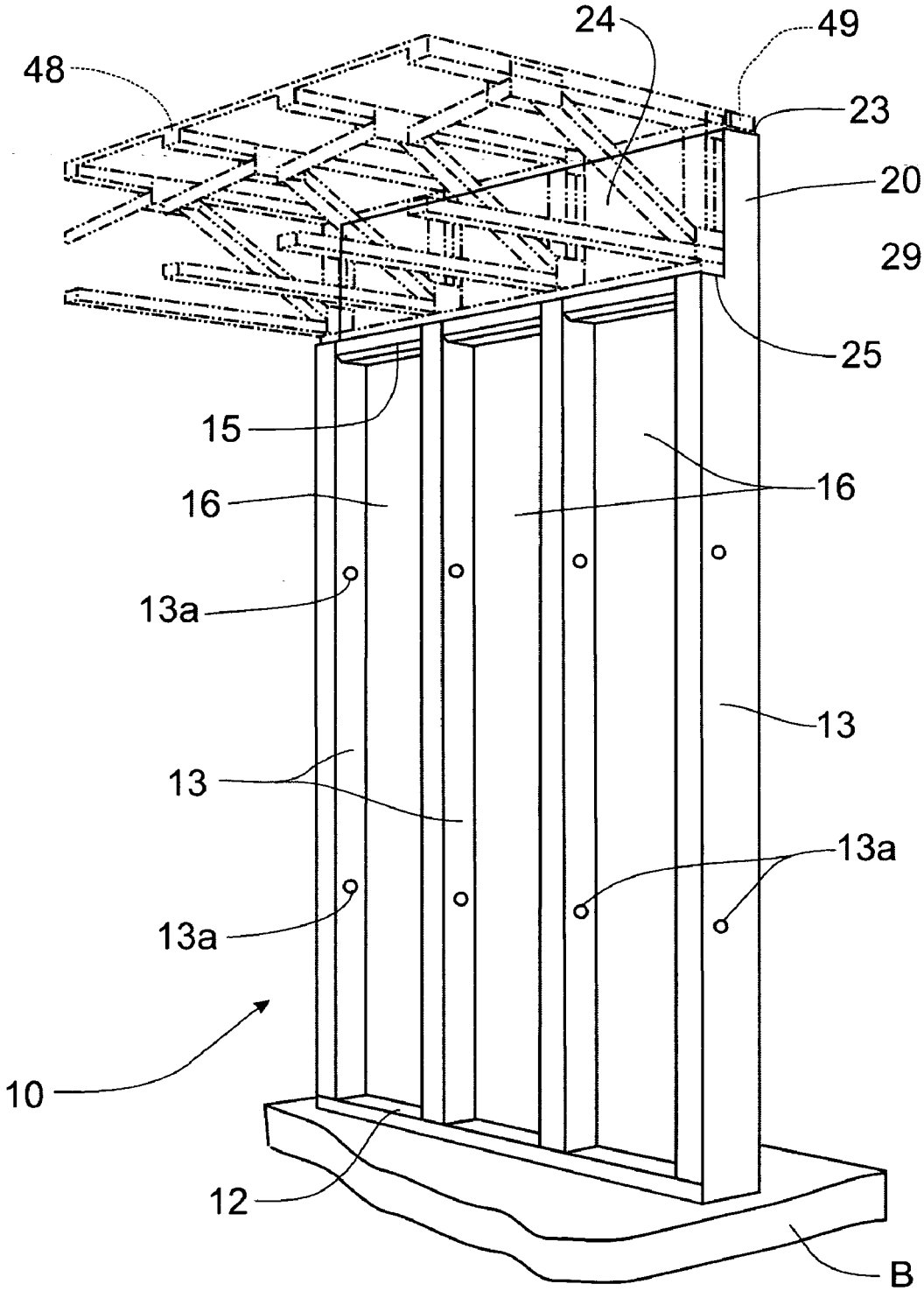
FIG. 1 is a perspective view of a pre-cast concrete wall panel incorporating the principles of the instant invention, a portion of a representative floor truss system, supported on top of the upper bond beam, being depicted in phantom.

Referring to FIGS. 1-5, a pre-cast concrete wall system incorporating the principles of the instant invention can best be seen. The wall panel 10 is pre-cast in a form at a manufacturing plant, as is reflected in FIGS. 6 and 7 and will be described in greater detail below, and then transported when the concrete is cured to the job site for installation according to a known process involving the mounting of the walls 10 on a bed of crushed stone B and fastening the wall panels 10 together in a pre-arranged manner to form a basement or foundation wall on which a building will be subsequently erected. The wall panel 10 is formed with a generally horizontally oriented footer beam 12, an upper bond beam 15 oriented generally parallel to the footer beam 12, and a predefined number of generally vertical concrete studs 13 extending between the footer beam 12 and the upper bond beam 15. Between the concrete studs 13, the recessed wall shell 14 is insulated with a sheet of polystyrene 16 facing the interior side of the wall 10. Preferably, the concrete studs 13 are formed with access holes or chases 13*a* passing generally horizontally through the concrete studs 13 to allow the passage of wiring or plumbing within the confines of the wall panel 10.

In the wall panel 10 depicted in the drawings, a truss ledge 20 is formed with the wall shell 14 and upper bond beam 15 to project upwardly above the upper bond beam 15 when assembled into a basement foundation. The truss ledge 20 has an outer concrete shell 22 that is contiguous with the wall shell 14 and the upper bond beam 15 and terminates at a top surface 23 elevated above the upper bond beam 15 to receive a floor truss system 48 as will be described in greater detail below. The interior surface of the truss ledge 20 is faced with an insulation panel 24 in the same manner as the wall shell 14 below the upper bond beam 15. The overall thickness of the truss ledge 20 is less than that of the upper bond beam 15 thus forming a truss support surface 25 on top of the upper bond beam 15.

Typically, a sill plate 29 is affixed to the truss support surface 25 on top of the upper bond beam 15 to provide a uniform fastening medium for the floor trusses 48 to be mounted to the basement foundation. When the floor trusses 48 are properly positioned on the truss support surface 25, the top surface 23 of the truss ledge 20 has a secondary sill plate 49 for supporting the floor member of the floor trusses 48, whereby the truss ledge 20 becomes the exterior surface of the flooring system 48 for the building. Under this configuration, the top surface of the floor to be above the ground surface around the foundation and positioned at the same height as the floor surface over the portions of the building that are supported on a traditional concrete slab adjacent to the basement portion of the building.

Figure 2:
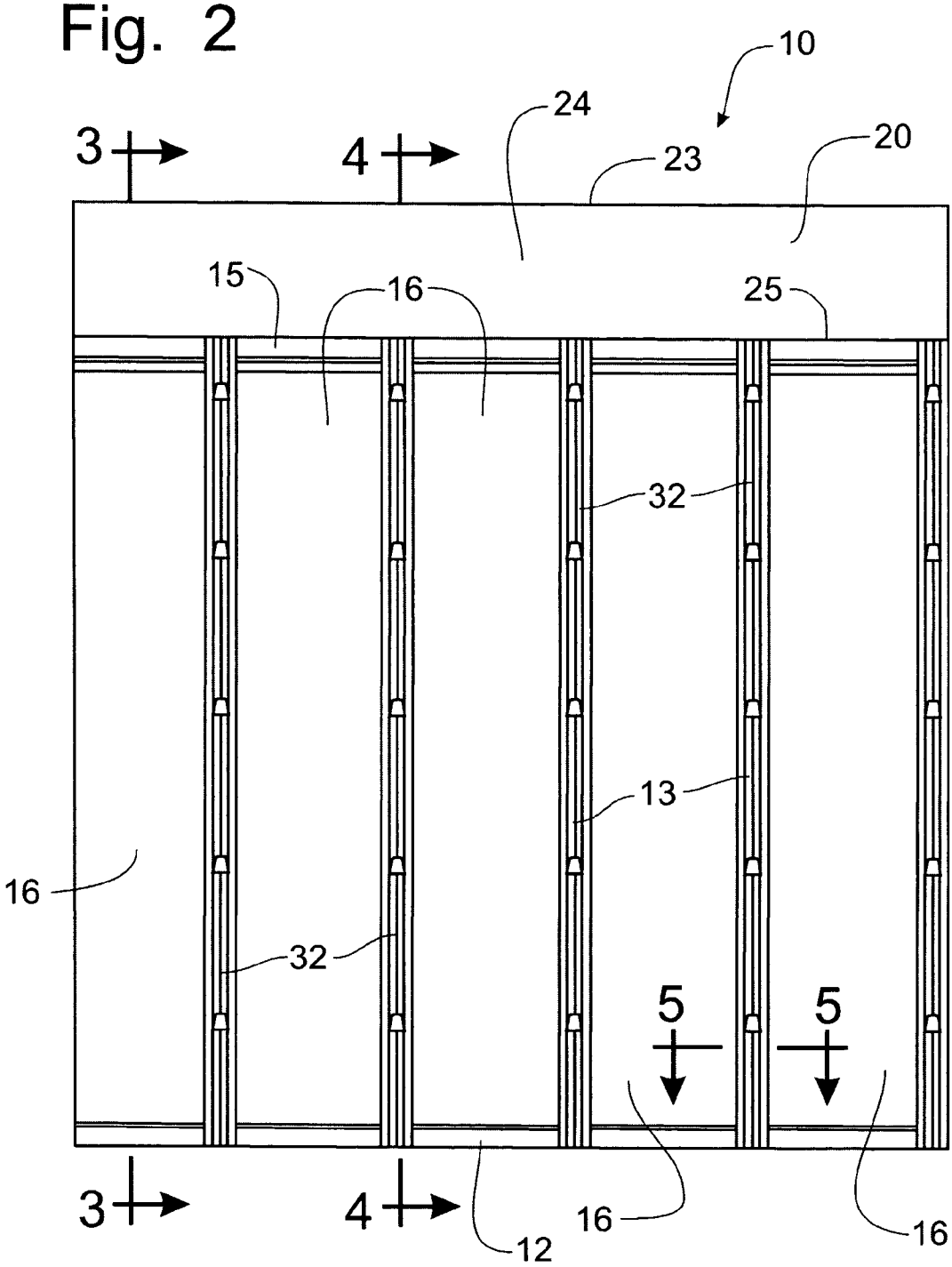
FIG. 2 is an interior front elevational view of a portion of an assembled basement foundation formed from pre-cast concrete wall panels incorporating the principles of the instant invention.

The formation of the wall panel 10 is best seen in FIGS. 6 and 7. A metal form 30 defining a support for the pouring of concrete to create the wall panel 10 is positioned in a horizontal orientation such that the wall panel 10 is formed horizontally, as opposed to the deployment of the wall panels 10 in the assemblage of the basement foundation in a vertical orientation. The form 30 is manufactured from steel to provide durability and to permit the form to be re-used many times before requiring replacement. Galvanized stud facing 32, best seen in detail in FIGS. 2, 8 and 9, is positioned along the form 30 at the locations for formation of the concrete studs 13. Once formed into the wall panel 10, the galvanized stud facing 32 becomes the interior surface of the concrete studs 13 to allow the attachment of finishing materials (not shown) to create a finished basement structure in the completed building.

Referring now to FIGS. 8 and 9, the galvanized stud facing 32 is manufactured with fold-up reinforcing bar supports 33. Preferably, the reinforcing bar supports 33 are stamped into the surface of the facing 32 by cutting out the material around each support 33. The surface of the stud facing 32 is preferably ribbed with three longitudinally-extending reinforcing ribs 34. At each fold-up reinforcing bar support 33, the central reinforcing rib 34 is formed with a dimple cutout 33*a* that enables the reinforcing bar support 33 to be folded perpendicularly to the orientation of the facing 32 without forming a dimple at the central reinforcing rib 34. The supports 33 are formed in a "Y" configuration with pointed tips 36 and a V-notch 37 therebetween. The steel reinforcing bar 17 for the concrete stud 13 is laid on top of the folded-up supports 33 within the V-notch to properly position the reinforcing bar within the finished concrete stud 13.

Before the reinforcing bar 17 is placed on the supports 33, a U-shaped polystyrene foam channel 35, best shown in FIGS. 5 and 10, is placed over the folded-up supports 33 with the pointed tips 36 punching through the polystyrene foam material. The channel 35 defines the outer surface of the concrete stud 13, supported by the galvanized stud facing 32 placed in the form 30. The top of the legs of the polystyrene foam channel 35 are formed with support ledges 38 on which the polystyrene insulation sheets 16 are placed for support thereof in the final wall assembly. The tops of the legs of the foam channel 35 are formed with rounded interior corners 39 to eliminate stresses otherwise encountered with square concrete corners. The channels 35 can also be used to mount spreader wires 42 that are positioned near the footer beam 12 to maintain the spacing of the upright walls of the channel 35 and to provide a support for one of the steel reinforcing bars 18 to be placed into the heel of the footer beam 12. Another steel reinforcing bar 18 is located at the toe of the footer beam 12 and is properly positioned by a rebar support wheel 44 supported by the form 30.

The form 30 is oriented to provide support for the polystyrene insulation board 16 on the interior face of the truss ledge 20 above the upper bond beam 15. A steel reinforcing bar 19 is supported on respective rebar support wheels 44 to extend from the concrete portion of the truss ledge 20 through the upper bond beam 15 and into the concrete stud, thus structurally tying these concrete portions together. One skilled in the art will recognize that openings for windows and doors, which have not been shown and described herein, but are within the state of the art of forming pre-cast concrete wall systems, may be formed in a conventional manner within the wall panels 10. Similarly, it is within the conventional state of the art to form wall panels 10 that are to be located at the corners of the completed basement foundation structure with bevel edges at 45 degree angles to mate into a corner of the foundation.

The access openings 13*a* are formed by locating foam inserts 45 between the upright walls of the polystyrene foam channels 35. By using hollow foam inserts, the chases 13*a* will be insulated between the wiring or plumbing passing through the opening 13*a* and the surrounding concrete stud 13. The chase insulation diminishes the accumulation of condensation in the wall panel 10. Finishing the basement wall is accomplished by fastening finishing material, such as drywall or paneling, to the interior faces of the concrete studs 13, which are faced with the galvanized stud facing 32 and the polystyrene foam channel 35. The galvanized stud facings 32 provide structure for the engagement of fasteners connecting the finishing material to the wall panels 10.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A pre-cast concrete wall panel comprising:

a footer beam operable to support said wall panel on a surface, said footer beam oriented horizontally when said wall panel is installed into a basement foundation;

an upper bond beam located vertically above said footer beam and oriented generally parallel thereto;

a plurality of generally vertical stud members interconnecting said footer beam and said upper bond beam, each said stud member being formed with a rigid facing member on an interior front face thereof, a monolithic, free-standing U-shaped foam channel on which said facing member is mounted, and a concrete core formed within said foam channel, said facing member overlapping a portion of opposing exterior side faces of said foam channel extending generally perpendicularly to said front face such that said exterior side faces of said foam channel are exposed on an interior side of said pre-cast concrete wall panel, said foam channel defining an interior insulation barrier for said concrete core of said stud member;

a fold-up reinforcing bar support member integrally formed in said facing member, said reinforcing bar support member being oriented generally perpendicularly to said interior face of said stud member and projecting through said U-shaped foam channel to support a reinforcing bar for incorporation into said concrete core when said wall panel is being manufactured; and a monolithic concrete shell incorporating said footer beam, said upper bond beam and said vertical stud members and forming a truss ledge projecting generally vertically above said upper bond beam, said truss ledge terminating in a top surface elevated above said upper bond beam.

2. The pre-cast concrete wall panel of claim 1 wherein said truss ledge has a thickness dimension that is smaller than a corresponding thickness dimension of said upper bond beam, whereby a truss support surface is formed on top of said upper bond beam.

3. The pre-cast concrete wall panel of claim 1 wherein said facing member is also formed with reinforcing ribs extending along said interior face of said stud member, said reinforcing bar support member being formed with a dimple cutout on at least one of said reinforcing ribs to prevent said reinforcing rib from buckling when said reinforcing bar support member is oriented perpendicularly to said interior face, each said stud member further being formed with generally horizontal openings extending therethrough for the passage of electrical wiring and/or plumbing, said openings being insulated with a foam tube.

4. The pre-cast concrete wall panel of claim 1 wherein said concrete shell is formed with a foam insulation board on an interior side of said wall panel between said stud members.

5. The pre-cast concrete wall panel of claim 4 wherein said foam channel has a pair of spaced legs terminating adjacent said concrete shell, each said leg being formed with a support cutout on which one of said insulation boards is supported during the manufacturing of said wall panel.

6. The pre-cast concrete wall panel of claim 5 wherein said foam channel is formed with rounded corners on an inside surface of said foam channel to prevent said concrete shell and integral stud member from being formed with square corners.

7. The pre-cast concrete wall panel of claim 4 wherein said truss ledge is formed with a foam insulation board on an interior side thereof.

8. In a pre-cast concrete wall panel having a generally horizontal footer beam for positioning below grade, an upper bond beam located vertically above said footer beam and oriented generally parallel thereto, said upper bond beam being positioned above grade, a plurality of generally vertical stud members interconnecting said footer beam and said upper bond beam, and a monolithic concrete shell located on an exterior surface thereof and incorporating said footer beam, said upper bond beam and said stud members, the improvement comprising:

a truss ledge integrally formed with said monolithic concrete shell and projecting vertically above said upper bond beam to be located above grade and provide an exterior concrete surface for a floor truss system, said concrete shell having foam insulation on an interior side thereof both above and below said upper bond beam such that said truss ledge has insulation placed between said concrete shell and said floor truss system, each said vertical stud member having a monolithic foam channel on said interior side provided with a rigid stud facing member on an outer front face of said foam channel, said facing member including an integral reinforcing bar support member oriented perpendicularly to said front face and projecting through said foam channel to secure said foam channel on said facing member and to provide support for a reinforcing bar within said foam channel above said facing member.

9. The pre-cast concrete wall panel of claim 8 wherein said truss ledge has a thickness dimension that is smaller than a corresponding thickness dimension of said upper bond beam, whereby a truss support surface is formed on top of said upper bond beam on which said floor truss system can be supported.

10. A method of forming a pre-cast concrete wall panel comprising the steps of:

arranging a form in a size and configuration desired for said wall panel;

placing freestanding foam channels within said form at locations desired for the formation of stud members said foam channels having exposed outer foam side surfaces and a rigid stud facing member on an outer front face thereof;

placing insulation sheets on said foam channels to define an interior surface of said wall panel;

setting insulation members to define cavities for a footer beam and for an upper bond beam;

positioning an insulation panel to form a truss ledge that projects from said upper bond beam;

pouring concrete into said form to fill said foam channels, cavities for said footer beam and said upper bond beam, and to fill areas within said form defined by said insulation sheets and said insulation panel, thus creating a monolithic concrete shell that incorporates said footer beam, said upper bond beam, said stud members, and said truss ledge, said insulation panels establishing an insulated interior surface of said concrete shell both above and below said upper bond beam; and allowing said concrete to cure before removing said form.

11. The method of claim 10 wherein said positioning step defines a truss ledge having a thickness dimension smaller than a corresponding thickness dimension of said upper bond beam to create a truss support surface on top of said upper bond beam.

12. The method of claim 11 wherein said step of placing foam channels includes the steps of:

placing said rigid stud facing member corresponding to each said stud member into said form;

folding up reinforcing bar support members from said stud facing members;

pushing one of said foam channels onto said reinforcing bar support members until said reinforcing bar support members pass through said foam channel and said foam channel is positioned adjacent said stud facing member; and mounting a reinforcing bar on said reinforcing bar support members.

13. The method of claim 11 wherein said wall panel is formed with a planar exterior concrete surface that extends from a top surface of said truss ledge to said footer beam.

14. The method of claim 12 further comprising the step of inserting hollow foam cores through openings formed in said foam channels to define insulated access openings in said stud member for the passage of wiring and/or plumbing.

* * * * *